United States Patent [19]

Fike, Sr.

[11] Patent Number: 4,844,373

[45] Date of Patent: Jul. 4, 1989

[54] LINE STORAGE AND DISPENSING DEVICE

[76] Inventor: Richard A. Fike, Sr., 62 S. Lake, Madison, Ohio 44057

[21] Appl. No.: 134,951

[22] Filed: Dec. 18, 1987

[51] Int. Cl.[4] ..... B65D 85/04; B65D 85/02; B65H 49/18; B65H 55/00

[52] U.S. Cl. ..... 242/96; 206/389; 206/397; 206/398; 206/409; 242/55.53; 242/85; 242/100

[58] Field of Search ..... 242/96, 85, 100, 84.8, 242/55.53; 206/389, 397, 398, 409; 182/231, 233, 73, 236–240

[56] References Cited

U.S. PATENT DOCUMENTS

| | | | |
|---|---|---|---|
| 874,130 | 12/1907 | Stanley | 242/96 |
| 1,364,031 | 12/1920 | Brenizer | 242/96 |
| 1,545,312 | 7/1925 | Dolan | 242/100 |
| 1,653,858 | 12/1927 | Kindler et al. | 242/100 X |
| 1,990,135 | 2/1935 | Sato | 242/96 |
| 2,526,065 | 10/1950 | Chodaki et al. | 182/236 |
| 2,680,593 | 6/1954 | McIntyre | 182/231 |
| 2,683,000 | 7/1954 | Beiderwell | 242/96 |
| 3,420,503 | 1/1969 | Stangl | 182/235 |
| 3,423,044 | 1/1969 | Beiderwell | 242/96 |
| 3,438,595 | 4/1969 | Brown et al. | 242/96 |
| 3,693,784 | 9/1972 | Holmes | 206/409 |
| 4,168,778 | 9/1979 | Buxton | 206/409 |
| 4,200,249 | 4/1980 | Synstelien et al. | 242/96 |
| 4,463,830 | 8/1984 | Geurtsen | 182/238 |
| 4,469,196 | 9/1984 | Sadler | 182/236 |
| 4,480,716 | 11/1984 | Soubry et al. | 182/233 |
| 4,588,046 | 5/1986 | van der Neer et al. | 182/236 |
| 4,606,134 | 8/1986 | Flick | 206/409 X |
| 4,676,446 | 6/1987 | Ciocarelli et al. | 242/55.53 |
| 4,706,904 | 11/1987 | Raymond | 242/55.53 |
| 4,754,875 | 7/1988 | Rauffer et al. | 206/389 X |

*Primary Examiner*—John Petrakes

*Attorney, Agent, or Firm*—D. Peter Hochberg; Mark Kusner; Louis J. Weisz

[57] ABSTRACT

A disposable, cord dispensing device comprising a rigid, shatterproof plastic housing defining an internal cord holding cavity of substantially cylindrical shape. A spool having two circular flange portions connected by a stem portion is provided to be received within the cylindrical cavity of the housing and to freely rotate therein. The spool is retained within the cavity, and a predetermined length of high strength, small diameter test cord is machine-wound in dense-packed fashion thereon. An end of the cord passes through the housing and is accessible for use.

14 Claims, 3 Drawing Sheets

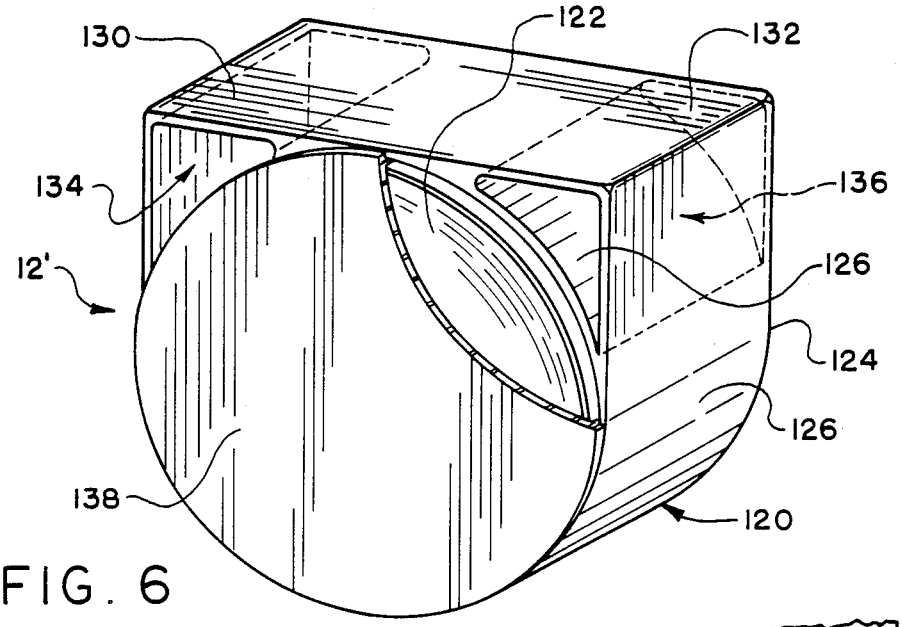
FIG. 6
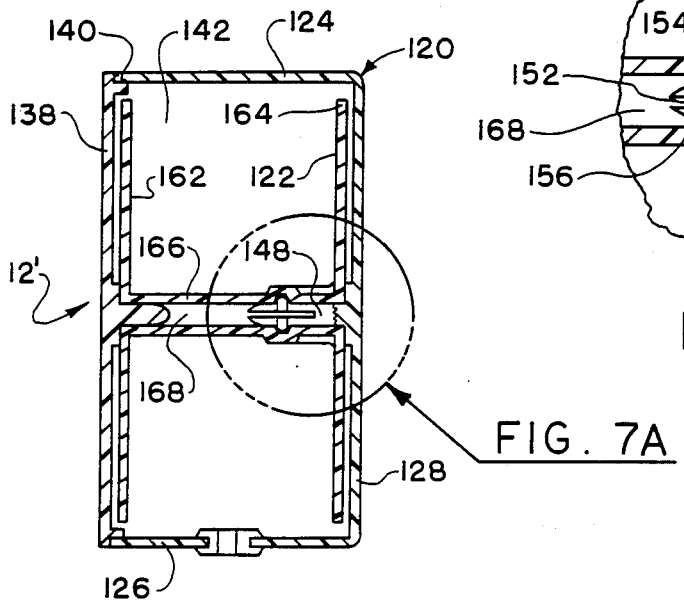
FIG. 7
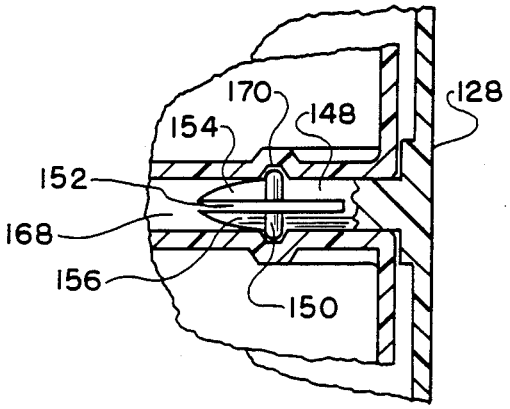
FIG. 7A
FIG. 7A

LINE STORAGE AND DISPENSING DEVICE

FIELD OF THE INVENTION

The present invention relates to a compact container for cord and the like, and more particularly, to a light weight, portable cord containing and dispensing device.

BACKGROUND OF THE INVENTION

High strength, small diameter cord of the type disclosed in the United States Military specification for nylon cord, MIL-C-5040F dated Mar. 23, 1981, has numerous applications and uses in all branches of the military. Such cord is used to secure personal equipment onto belts, back-packs and vehicles, as well as to erect to secure shelters and tents. Applications for such cord range from replacements for boot laces to a life line in emergency repelling situations. In medical situations, it may be used to apply a tourniquet or a splint, or as an emergency tow or drag-line for rescues. The inner nylon fibers may even be used as sutures in extreme medical emergencies. In similar respects, the inner strands of such cord have been used in survival applications to produce nets, snares, or fishing line.

With respect to individuals, such cord or line is extremely useful around the house in gardening, landscaping and as means for securing objects for storage. Likewise, high strength cord finds many advantageous applications with cave explorers, back-packers, campers, hunters, boaters, mountaineers and rescue personnel. Indeed, for the outdoor person, a reliable high-strength cord is almost a necessity.

Such high strength, small diameter cord would also find application in numerous every-day situations encountered by public safety forces. For example, policemen or firemen could utilize such cord or line to rope off (i.e. to secure) scenes of accidents, crimes or fires. The cord could also be used to secure objects, restrain animals, or secure prisoners. A cord or line of sufficient strength could be utilized as an emergency line in situations involving ice, water or snow rescues. In the case of fires, a fire resistant cord would be extremely useful in assisting a rescuer in finding his/her way out of a burning building, allowing others to track injured or lost rescuers, or if necessary, as a building escape line from elevator locations in the burning building.

Thus, while it is abundantly clear that small diameter, high-strength cord or test line has application in numerous every-day situations in many occupations, a clear problem is that such cord is never immediately available when needed. If available at all, it is generally found loose or in a wrapped bundle stored in the trunk of a vehicle or in the bottom of the back-pack, often tangled when needed. The present invention overcomes this and other problems and provides a portable, light weight, hip-carried device for storing and dispensing high strength line wherein the line is immediate, available and easily extracted for use.

SUMMARY OF THE INVENTION

In accordance with the present invention, there is provided a disposable, cord dispensing device comprising a rigid, shatterproof plastic housing defining an internal cord holding cavity of substantially cylindrical shape. A spool having two circular flange portions connected by a stem portion is provided to be received within the cylindrical cavity of the housing and to freely rotate therein. The spool is retained within the cavity, and a predetermined length of high strength, small diameter cord is machine-wound in dense-packed fashion thereon. An end of the cord passes through the housing and is accessible for use.

In accordance with another aspect of the present invention, there is provided a device for storing and dispensing high strength, small diameter cord comprising in combination a case or pouch attachable to a support belt to be worn by an individual and a cord storing and dispensing cartridge. The case includes a main body portion defining a cartridge receiving opening and a cover portion attached to the body portion for enclosing the cartridge receiving opening. The cord storing and dispensing cartridge is dimensioned for insertion into the receiving opening of the case. The cartridge is comprised of a plastic, shatterproof housing defining a cord holding cavity therein. The cord holding cavity is substantially cylindrical in shape and is dimensioned to receive a spool therein. The spool includes a length of high strength, small diameter cord machine would thereabout. The end of the cord passes out through the cartridge housing and case.

It is an object of the present invention to provide a cord dispensing device for storing and dispensing high-strength, small diameter line or cord for use by individuals, military personnel, public safety forces and the like.

Another object of the present invention is to provide a device as described above wherein the cord is capable of being worn by an individual with the cord being immediately available for use.

Another object of the present invention is to provide a device as described above which includes high strength, fire resistant nylon cord suitable for a wide variety of uses and applications stored in a compact, light-weight dispenser.

Another object of the present invention is to provide a device as described above wherein the cord is carried in a replaceable disposable plastic cartridge.

A still further object of the present invention is to provide a device as described above wherein the cord to be dispensed includes indications of length.

An even further object of the present invention is to provide a cord dispensing device as described above having physical properties which are acceptable for use in military applications.

Another object of the present invention is to provide a device as defiend above which is inexpensive and manufacture, and simple and easy to use.

These and other objects and advantages will become apparent from the following description of preferred embodiments taken together with the accompanying drawings.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 6 is a partially-sectioned perspective view of a cord storage and dispensing device illustrating an alternate embodiment of the present invention;

FIG. 7 is a sectional view of the device shown in FIG. 6; and

FIG. 7A is an enlarged sectional view of the area designated 7A of FIG. 7.

DETAILED DESCRIPTION OF THE PREFERRED EMBODIMENT

Figure 1:
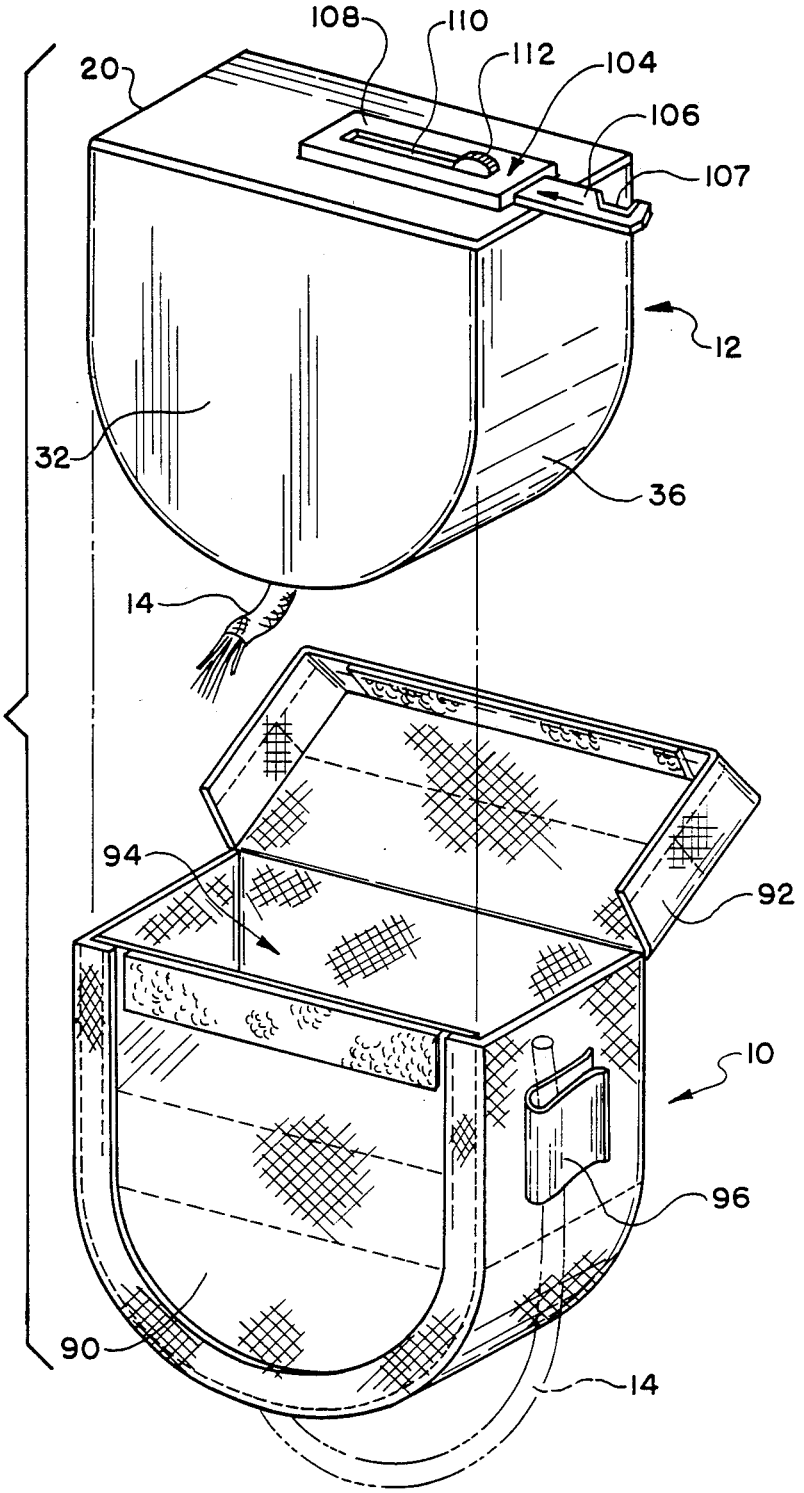
FIG. 1 is an exploded perspective view of a cord storage and dispensing device illustrating a preferred embodiment of the present invention.
Figure 3:
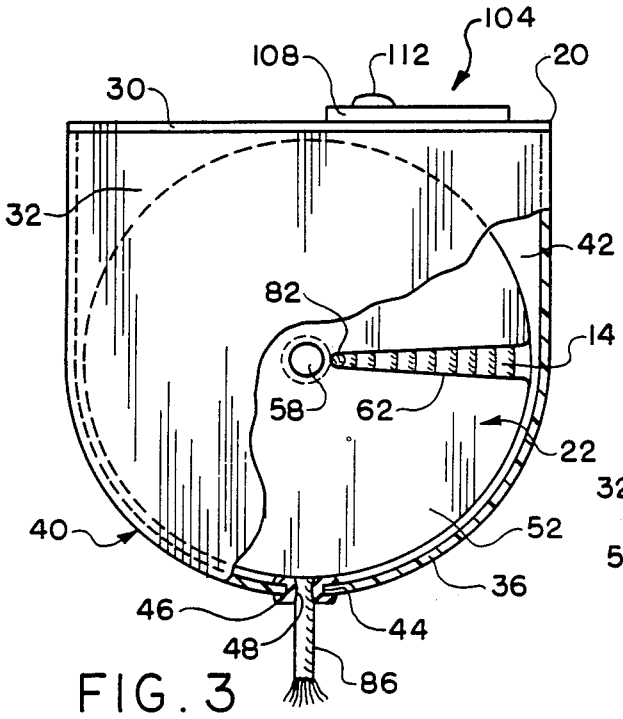
FIG. 3 is a partially sectional front elevational view of the cartridge shown in FIG. 2.
Figure 2:
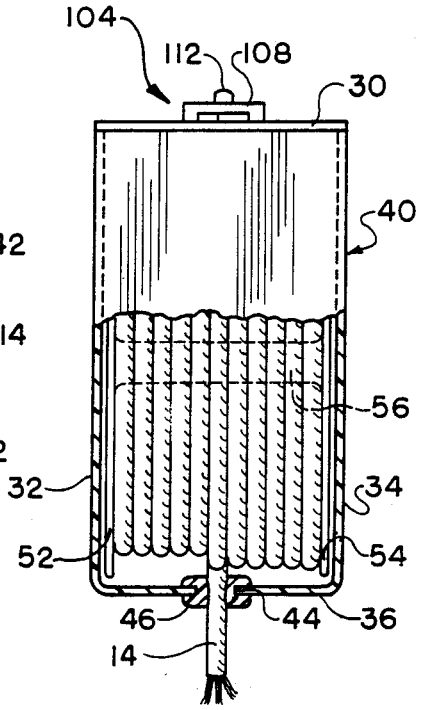
FIG. 2 is a partially sectioned elevational view illustrating a cord storage and dispensing cartridge according to the present invention.
Figure 4:
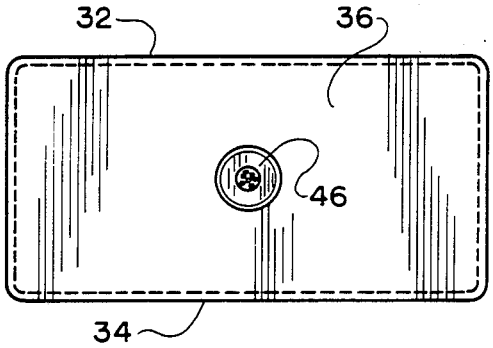
FIG. 4 is a bottom view of the cartridge shown in FIG. 2.

Referring now to the drawings wherein the showings are for the purpose of illustrating preferred embodiments of the invention only and not for the purpose of limiting same, FIG. 1 illustrates a cord for storing and dispensing device comprised of a case 10 and a cartridge 12 containing a predetermined length of cord 14. Cartridge 12 is comprised of a housing 20 and a spool 22 adapted to be received therein. Housing 20 includes an upper wall section 30, a front wall section 32, a rear wall section 34, and a U-shaped wall section 36 defining the lower and lateral surfaces of housing 20. In the embodiment shown, best seen in FIGS. 1–4, wall sections 32, 34 and 36 are molded or otherwise formed into an integral U-shaped housing member designated 40. Upper wall section 30 is a separate member dimensioned for attachment to housing member 40. U-shaped housing member 40 defines a cylindrical cavity 42 for receiving spool 22 therein. An aperture 44 is provided through the lower portion of U-shaped wall section 36. Aperture 44 is centrally disposed between front and back wall sections 32, 34 as best seen in FIG. 2. Spool 22 includes two circular flange portions 52, 54 connected by a stem portion 56. An axially aligned bore 58 extends through stem portion 56 as best seen in FIG. 3. Flange portion 52 is provided with elongated slot 62 radiating outward from the center of flange 52 to the peripheral edge thereof. Bore 58 and slot 62 are utilized in the process of winding cord 14 onto spool 22 as will be described in greater detail below.

Figure 5A:
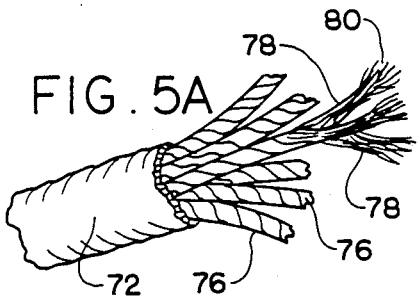
FIG. 5A is an enlarged sectional view of the area designated 5A in FIG. 5.
Figure 5:
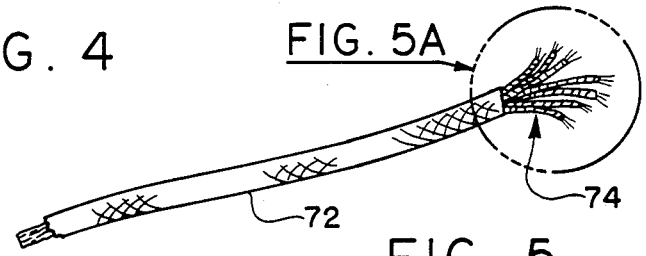
FIG. 5 is a perspective view illustrating the construction of the cord utilized in the present invention.

In the embodiment disclosed, cord 14 is a high strength nylon cord or the like. Such a cord is disclosed in United States Military specification MIL-C-5040F dated Mar. 23, 1981, the disclosure of which is incorporated by reference herein. (Copies of such specification are available from the United States Army Natick Research and Development Laboratories, Natick, MA01760). As shown in FIGS. 5 and 5A, such cord 14 includes an outer sleeve 72 of woven nylon material encasing an inner core of 74 comprised of a plurality of strands 76. Each strand 76 is comprised of a plurality of threads 78, each of which is formed from a plurality of twisted monofilament nylon fibers 80. Strands 76 are loosely arranged within sleeve 72, such that cord 14 can assume other than completely circular configurations. In other words, cord 14 can be flattened or compressed out of round.

According to the present invention, cord 14 is machine wound onto spool 22. The cord 14 is machine wound onto spool 22 to maximize the amount of cord on a spool of given dimension. In general terms, the winding process comprises mounting spool 22 onto a rod or spindle of a machine (not shown) and attaching an end 82 of cord 14 onto spool 22. A hole or slot may be provided in stem portion 56 to attach end 82. In the preferred embodiment, slot 62 in flange portion 52 is utilized to hold end 82 of cord 14. Specifically, a knot (not shown) is tied in the end of cord 14, and such end is slipped into slot 62 such that the knot is situated on the outer surface of flange portion 52. Spool 22 would then rotate to wind a predetermined length of cord 14 thereon. A tension is exerted on cord 14 during winding to densely pack the cord 14 on each spool 22. The cord 14 is wrapped onto spool 22 until the outer extent of the cord reaches the peripheral edges of flanges 52 and 54. With respect to the embodiment disclosed heretofore, a spool 22 having flange portions 52, 54 which are three (3) inches in diameter and a stem portion 56 which is five-sixteenths (5/16) inches in diameter and one and one half (1½) inches long (i.e., a spacing of approximately one and one half (1½) inches exists between the inner surfaces of flange portions 52, 54) can hold approximately sixty (60) feet of five hundred (500) pound test cord (Type III cord of United States Military specification MIL-C-5040F dated Mar. 23, 1981) when machine wrapped. In this respect, the usable cord storage space on a spool 22 of the dimensions just described, is approximately ten (10) cubic inches. Accordingly, approximately six (6) feet of Type III cord per cubic inch may be stored on spool by machine wrapping. It will of course be appreciated that the type of cord used in cartridge 12 will affect the amount stored therein. With any type of cord, however, machine wrapping increases the length per cubic inch which may be stored on spool 22 as compared to manual wrapping or loose storage. Thus, according to the present invention, a cartridge approximately three (3) inches by three (3) inches by one and one half (1½) inches can store approximately sixty (60) feet of high-strength cord.

Spool 22, with cord 14 wrapped thereon, is disposed within cylindrical cavity 42 of U-shaped housing 40, as shown in FIG. 2. The free end 86 of cord 14 passes through opening 48 in grommet 46. In this respect, grommet opening 48 is dimensioned to slightly compress and frictionally engage cord 14 as it passes therethrough. The frictional contact between cord 14 and grommet opening 48 provides means for maintaining a slight tension on cord 14 as it is withdrawn from cartridge 12. Upper wall section 30 is secured to U-shaped housing 40 with spool 22 confined between U-shaped wall section 36 and upper wall section 30. Upper wall section 30 may be glued to housing member 40, but in the preferred embodiment is ultrasonically welded thereto. U-shaped housing 40 and spool 22 are dimensioned such that spool 22 freely rotates therein. In normal operation, the peripheral edges of the flange portions 52,54 slide along the curved inner surface of U-shaped wall section 36. Frictional engagement therebetween, together with the "binding", frictional contact caused by grommet 46 on cord 14 ensures that cord 14 will not unintentionally be dispensed from the cartridge.

Housing 20 is preferably formed of a rigid, structural plastic material which is shatterproof and of sufficient dimensional stability to withstand a dead weight of approximately 500 lbs., and which is able to withstand temperature extremes of −40° F. to 260° F. without shattering or rupturing. In this respect, housing 20 may be molded or otherwise formed from such polymers as polyesters, polycarbonates or polyacrylates. It is intended for the purposes of the present invention that the term "polymer" includes copolymers, polymer mixtures and homopolymers. Because spool 22 is disposed within housing 20 and has no load bearing function, it may be made from plastic material or lesser structural integrity such as polystyrene, polypropylene, polyethylene, or the like. In the preferred embodiment, both spool 22 and housing 20 are formed of a acetal polymer material. With such material, the thickness of wall sections 30, 32, 34 and 36 of the embodiment shown are approximately five-hundredths (0.05) inches. Housing 20 is also preferably formed from a clear plastic material to allow a user to monitor the amount of cord 14 remaining on spool 22.

As set forth above, cartridge 12 is adapted to be received in a pouch or case 10 which may be formed from canvas, nylon, leather or the like. Case 10 is comprised of a main body portion 90 and a cover portion 92. Body portion 90 defines a cartridge receiving opening 94 to receive cartridge 12 therein. A hole or aperture (not shown) is provided in body portion 90 in registry with aperture 44 in cartridge 12 to facilitate cord 14 passing through case 10. Means may be provided to secure loose cord, (i.e. cord drawn outside case 10) to the outer surface of case 10. In this respect, a U-shaped clip 96 or the like may be provided on the side of case 10 into which loose or extracted cord may be attached as shown in FIG. 1 wherein cord 14 is shown in phantom. In this respect, loose cord may be wedged into the U-shaped portion of clip 96 to prevent it from dangling below the case 10.

Means to cut drawn cord 14 may be provided on cartridge 12 in the form of a retractable knife arrangement 104 as seen in FIGS. 1-3. Knife arrangement 104 is comprised of a knife blade 106 confined between upper wall section 30 of housing 20 and an elongated knife housing 108. Housing 108 includes elongated slot 110 therein. Knife blade 106 includes a cutting edge 107 (which may be hook-shaped as shown in FIG. 1) for quickly severing lengths of cord 14 drawn from cartridge 12. A button 112 secured to blade 106 extends through slot 110 above housing 108. In a manner as conventionally known, slot 110 is dimensioned to guide button 112 and blade 106 between a retracted position wherein blade 106 is shielded within housing 108, and an exposed position wherein blade 106 and cutting edge 107 are exposed for use in severing the cord 14. In such knife arrangement 104 is provided on cartridge 12, cover portion 92 of case 10 may be modified to allow access to such arrangement and to permit blade 106 to extend therethrough.

Referring now to FIGS. 6, 7 and 7A, several variations of the device shown heretofore are illustrated in another embodiment of a cartridge according to the present invention. FIG. 6 shows a cartridge designated 12' which includes a housing 120 and a spool 122. Housing 120 is comprised of a molded body section 124 which includes a completely cylindrical wall member 126 and a back wall member 128. Cylindrical wall member 126 and back wall member 128 define a cylindrical cavity 142. L-shaped wall members 130,132 are integrally formed with cylindrical wall member 126 to create a generally rectangular upper end on cartridge 12'. As best seen in FIG. 6, openings 134, 136 are defined between cylindrical wall member 126 and L-shaped wall members 130, 132. In the preferred embodiment, openings 134, 136 extend completely through cartridge 12° as shown in FIG. 6. A cover plate 138 is provided to enclose cavity 142. An annular lip 140 may be provided to locate plate 138 relative to cylindrical wall section 126. With respect to cartridge 12' as described heretofore, a spool 22 of the type disclosed in FIGS. 1–5, may be disposed within cavity 142. In this respect, cover plate 138 may be dimensioned to be removable from body section 124 to permit replacement of spool 22 therein, or may be permanently secure to body section 124 by glue, ultrasonic welding, or the like to provide a disposable unit.

In the embodiment shown, back wall 128 is provided with a laterally extending spike 148 (best shown in FIG. 7A) having an annular ridge 150 thereon. A slot 152 is molded or otherwise formed in spike 148 to provide spike-section 154, 156. Spike 148 is centrally disposed with respect to back wall 128 such that spike 148 extends along the axis of cylindrical cavity 142. Referring now to spool 122, spool 122 includes two circular flange portions 162, 164 connected by a stem portion 166. An axially aligned bore 168 extends through stem portion 166 as best seen in FIG. 7. One end of stem portion 166 is reinforced (see FIG. 7A) and includes an annular groove 170 recessed into bore 168. Groove 170 and bore 168 are dimensioned to operatively interact with spike 148 in a snap lock fashion as is conventionally known, wherein spool 122 is rotatable thereon. Spool 122 may be "snapped" into position within cylindrical cavity 142. In this respect, spool 122 and spike 148 provide an spool arrangement wherein when the cord on a given spool has been used, the spool may be removed from cavity 142 and a new spool inserted therein. Cover plate 138 may be provided with a pin 172 as shown in FIG. 7 to maintain alignment of spool 122 in cylindrical cavity 142. In this respect, pin 172 is axially aligned with spike 148 along the axis of cylindrical cavity 142.

Referring now to use of the present invention, there is provided a device for dispensing high strength, small diameter nylon cord in an immediate and available form. Cartridge 12 and case 10 may be attached to the belt of a serviceman or individual by means conventionally known. Positioned so, cord 14 may be easily withdrawn from the device by merely pulling it therefrom. The frictional contact between cord 14 and grommet 46 ensures that cord 14 does not unravel or be unintentionally withdrawn thereform. The desired length of cord 14 may be severed by a knife or by a blade arrangement 104 as disclosed herein. The attached cord remaining outside case 10 may be wrapped therearound, tucked under the case cover or into the individuals belt, or wedged into a clip 96 if such is provided. As set forth above, such device is extremely desirable to military personnel, especially the foot-soldiers, who constantly are confronted with situations wherein such cord is extremely useful. Importantly, with present invention, the cord is immediate and available to a soldier at his hip as compared to situations wherein cord is either buried loose or in a bundle in a back pack, or not available at all. The availability and immediacy of the cord provides the military personnel with a life line in situations required in repelling, river patrolling, camping, with a bomb detonator control cord in boobie trap situations, or with sutures in an emergency medical situation. In these and other similar instances, the availability and immediacy of the cord can be the difference between life and death. With respect to individuals and public service forces, it will likewise be appreciated that the present invention would find advantageous application in any situation in which a length of cord would be desirable. For example, police/security forces would have at their disposal means to secure multiple prisoners in a riot/high threat situation.

The present invention has been described with respect to preferred embodiments. Modifications and alterations will occur to others upon the reading and understanding of the specification. In this respect, other types of cords may be used with the present invention. For example, specific applications may require a specific type of cord. A fire resistant cord may be desirable for use by firemen. A fluorescent or brightly colored cord may be beneficial to police officers for "roping-off" areas or for night use. In addition, a cord including indications of length may be useful to police officers in measuring distances at accident scenes. The use of cords with such features, and combinations thereof, is considered part of the present invention. It is intended that all such modifications and alterations to be included insofar as they come within the scope of the patent as claimed or the equivalents thereof.

Having thus described invention, the following is claimed:

1. A hip-carried apparatus for dispensing high strength, small diameter cord comprising a case attachable to a support belt, said case having a main body defining a cartridge receiving opening and a cover portion attached to said body portion enclosing said cartridge receiving opening; and, a disposable, cord holding cartridge dimensioned to be inserted into said receiving opening in said case, said cartridge comprised of a sealed, plastic housing having first and second housing sections of predetermined wall thickness ultrasonically welded into an integral housing unit, said housing defining a cord holding cavity of substantially cylindrical shape therein;

a spool having two flat, circular flange portions connected by a stem portion, said spool disposed within said cavity in said housing unit and dimensioned to rotate within said cavity when a predetermined force is exerted thereon; and, a length of high strength nylon cord machine wound about said stem portion of said spool, the end of said cord passing out through said housing unit and said case.

2. An apparatus as defined in claim 1 wherein at least one flange portion of said spool includes a radially extending slot therein.

3. An apparatus as defined in claim 1 further comprising friction means maintaining the position of said spool within said cavity when said force is not applied.

4. An apparatus as defined in claim 3 wherein said frictional means is comprised of the peripherally edges of said flange portions frictionally engaging said housing cavity.

5. An apparatus as defined in claim 1 wherein said housing unit is transparent.

6. An apparatus as defined in claim 1 wherein said housing unit and said case include apertures therein through which said cord passes, said apertures being in registry with each other and disposed on the lower sides of said housing unit and said case.

7. An apparatus as defined in claim 1 wherein said housing is generally U-shaped.

8. A cord dispensing cartridge comprising:

a rigid, shatterproof plastic housing including first and second housing sections which are rigidly secured to each other, said housing having a cord holding cavity of substantially cylindrical shape, a spool having two flat, circular flange portions connected by a small-diameter stem portion totally enclosed within said housing, said spool dimensioned to occupy substantially the entire space defined by said cylindrical cavity with the peripheral edges of said flange portions engaging the inner surfaces of said housing and to freely rotate therein, and a predetermined length of high-strength nylon cord machinewound in dense packed fashion about said stem portion of said spool, said cord having an outer sleeve of woven nylon encasing an inner core comprised of a plurality of nylon strands.

9. A cartridge as defined in claim 8 wherein said first and second housing sections are ultrasonically-sealed to each other.

10. A cartridge as defined in claim 8 further comprising means exerting a restraining force on cord being dispersed.

11. A cartridge as defined in claim 8 wherein said housing is a generally U-shaped member and further comprises a cover plate ultrasonically welded onto said housing for retaining said spool in said cavity.

12. A cord dispensing cartridge comprising:

a rigid, shatterproof plastic housing having a cord holding cavity of substantially cylindrical shape totally enclosed therein, a spool having two flat, circular flange portions connected by a small-diameter stem portion wherein said flange portions define a cord storage space therebetween, said spool disposed within said housing and dimensioned to substantially occupy the entire space defined by said cavity with the peripheral edges of said flange portions engaging the inner surfaces of said housing and to freely rotate therein, a predetermined length of high-strength cord machine-wound in dense-packed fashion in said cord storage space about said stem portion of said spool, a said cord having an outer sleeve of woven nylon and an inner core comprised of a plurality of nylon strands, which is packed within said space to have a cord length to space ratio greater than five (5) feet per cubic inch.

13. A cartridge as defined in claim 12 wherein said cord is fluorescent.

14. A cartridge as defined in claim 12 wherein said cord includes indicia of length marked thereon.

* * * * *